United States Patent [19]

Carrier

[11] 4,170,914

[45] Oct. 16, 1979

[54] CHEWING GUM CARRIER AND CUTTER

[76] Inventor: Vernon J. Carrier, 25830 Viana St., Lomita, Calif. 90717

[21] Appl. No.: 910,363

[22] Filed: May 30, 1978

[51] Int. Cl.[2] ..... B26D 1/34

[52] U.S. Cl. ..... 83/580; 83/610; 83/613; 83/648; 206/38; 206/39.5; 206/800; 225/43; 225/53; 225/89; 225/103

[58] Field of Search ..... 83/580, 610, 613, 648; 206/38, 39.5, 800; 225/27–32, 43, 53, 89, 103, 40

[56] References Cited

U.S. PATENT DOCUMENTS

| | | | |
|---|---|---|---|
| 1,155,791 | 10/1921 | Cabell | 206/800 X |
| 1,537,244 | 5/1925 | McCaghren | 206/39.5 X |
| 1,598,441 | 8/1926 | Haxton | 206/800 X |
| 2,510,306 | 6/1950 | Bachelder | 225/40 X |
| 3,397,818 | 8/1968 | Rey | 206/39.5 X |

*Primary Examiner*—Frank T. Yost
*Attorney, Agent, or Firm*—Edward D. O'Brian

[57] ABSTRACT

A chewing gum dispenser is described wherein a rectangular box having a top, a bottom, two sides, a front and a rear end is dimensioned to contain a plurality of sticks of gum when the sticks of gum are stacked one upon another within the interior of the box. The front end of the box has a slot extending from one side of the box to the other side adjacent to the top of the box. The box has an elongated hole in its top surface and a spring attached to the bottom of the box and extending within the interior of the box toward the top surface. The spring urges sticks of gum within the box toward the top such that the uppermost stick of gum fits against the inside of the top of the box resulting in a portion of the top stick of gum being exposed through the elongated hole. By frictionally engaging the top stick of gum with a finger inserted through the elongated hole the top stick of gum can be partially pushed out of the box through the slot. On the front end of the box is a blade which has a sharp edge on the top thereof. The blade passes over the slot and severs the stick of gum partially exposed through the slot. After severing the stick of gum the blade now covers the slot sealing the remaining portion of the stick of gum within the box.

4 Claims, 5 Drawing Figures

CHEWING GUM CARRIER AND CUTTER

BACKGROUND OF THE INVENTION

This invention is directed to a chewing gum dispenser which allows the user to carry one or more sticks of gum within the dispenser and to sever a stick of gum into one or more parts. The part of the stick of gum which is not immediately consumed is retained within the dispenser and the dispenser is sealed preventing the remaining portion of that stick of gum from being contaminated until it is also consumed.

Chewing gum is usually sold in packs with each individual stick wrapped in a metal foil-paper protective wrap. This requires that the consumer be satisfied with the amount of gum which is dispensed in each individual stick. Personal preference among consumers is such that many times a stick of gum is more gum than the user wishes to chew. Faced with this dilemma the usual case is that the chewer breaks the stick of gum into parts and saves the part not chewed in one's purse or pocket. The exposed end of this partial stick of gum inevitably gets contaminated with lint, bits of makeup, or other particulate matter that is normally found in the lower recesses of purses or pockets. When the user then goes to chew this stick of gum the end portion so contaminated must be broken off and discarded resulting in waste of the unchewed portion of the stick of gum.

BRIEF SUMMARY OF THE INVENTION

In view of the above it is a broad object of this invention to provide a chewing gum dispenser which dispenses a portion of a stick of gum and also serves as a storage receptacle for the remaining portion of the stick of gum not used. It is an additional object of this invention to provide a chewing gum dispenser which is both easy and convenient to use yet is of low cost to the consumer and economically manufactured.

In accordance with these and other objects there is described a chewing gum dispenser which is composed of a rectangular box having a top, a bottom, two sides, a front end and a rear end. The box is dimensioned to hold a convenient amount of sticks of chewing gum. The top of the box has an elongated hole in its surface and positioned on the bottom of the box is a flat spring which extends through the interior of the box toward the top surface. This spring serves to push the sticks of gum within the box toward the top surface wherein a portion of the top stick of gum is exposed through the elongated hole. On the front end of the box along the surface where the front end mates with the top a slot extends from one side of the box to the other side. This slot is dimensioned such that a single stick of gum can pass through the slot but two sticks of gum cannot. Fitting along the front end of the box is a cutting blade having a sharp edge along the top portion of it. The cutting blade slides along the front end and if a stick of gum is projecting out from this slot, when the cutting blade is slid along the front end, the sharp edge of the blade severs the stick of gum into two portions. One portion is dispensed to the consumer while the other portion of the gum remains inside the box. Further pushing the cutting blade toward the top surface seals the slot which protects the severed end of the stick of gum remaining in the box from contamination.

BRIEF DESCRIPTION OF THE DRAWING

The invention is best described when taken in conjunction with the drawing in which.

The invention in this specification utilizes such operative concepts and principles as are set forth and defined in the appended claims forming a part of this specification. Those skilled in the art to which this invention pertains will realize that these concepts or principles can be easily applied to a number of differently appearing and differently described embodiments. For this reason the invention is not considered to be limited to the precise embodiments illustrated in the figures but is to be considered in light of the appended claims.

DETAILED DESCRIPTION

Figure 1:
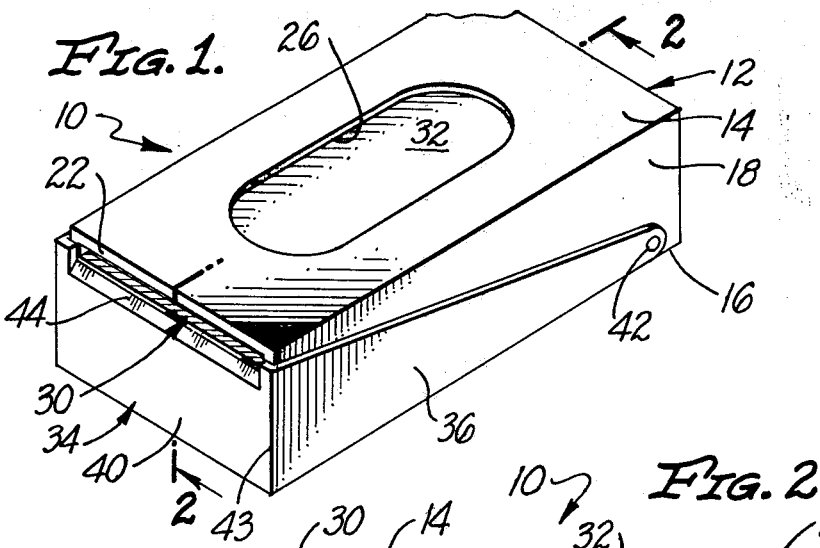
FIG. 1 is an isometric view of a chewing gum dispenser of the invention.
Figure 2:
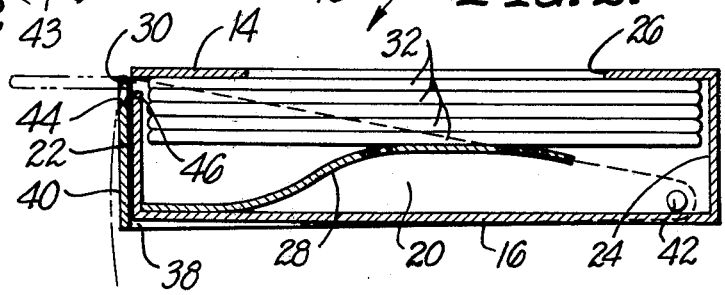
FIG. 2 is a sectional view along the lines 2—2 of the chewing gum dispenser illustrated in FIG. 1.

A chewing gum dispenser 10 illustrated in FIGS. 1 and 2 consists of a rectangular box 12 having a top 14, a bottom 16, two sides 18 and 20, a front end 22 and a rear end 24. In the top 14 there is an elongated hole 26 which exposes the interior of the box 12. The elongated hole 26 is dimensioned such that a portion of a user's finger (not shown) can be inserted through the hole 26.

Attached to the bottom 16 is a flat spring 28 which is bent so that it projects through the interior of the box 12 toward the top 14. Along the upper surface of front end 22 is a slot 30 which extends from side 18 to side 20.

The box 12 is loaded with a plurality of sticks of chewing gum collectively numbered as numeral 32 by inserting these sticks 32 one at a time through slot 30 and pressing down on the uppermost stick with a finger inserted through hole 26 while inserting a second stick 32 through the slot 30. The box 12 is so loaded by repeating this operation. This compresses spring 28 toward the bottom 16 putting it under tension. In reaction to this tension the spring 28 then urges the stack of the sticks of gum 32 within the interior of the dispenser 10 toward the top 14.

The individual sticks of gum 32 can now be dispensed at the user's convenience by frictionally engaging that portion of the top stick of gum 32 which is exposed through the elongated hole 26 with a finger. The stick of gum 32 is slid through slot 30 by sliding one's finger lengthwise through the opening of the elongated hole 26. In this manner whole sticks of gum can be dispensed if desired, or alternately, as further described, only a portion of a stick can be dispensed. The sticks of gum 32 are loaded in the chewing gum dispenser 10 complete with their usual foil wrapper as received from the manufacturer. Thus, the portion of the top stick of gum 32 which is exposed through the elongated hole 26 is protected by its foil covering.

In the embodiment shown in FIG. 1 the chewing gum dispenser 10 has a sealing and cutting blade bracket 34 which consists of a three-sided bracket wherein the side components 36 and 38 (side 38 is hidden from view in the drawings) and the end component 40 are attached to each other at a 90 degree angle when viewed from the top. This bracket 34 fits around front end 22 and is rotatably mounted to sides 18 and 20 by rivets collectively identified by numeral 42. The point of attachment of these rivets 42 is near where sides 18 and 20 meet with bottom 16, thus bracket 34 is free to swing in a downward direction but because of its point of attachment is near the bottom (not separately numbered) of sides 18 and 20. Bracket 34 fits flush with front end 22 when pushed in an upwardly direction and is not free to travel past the top of front end 22, e.g., the locus (shown in phantom in FIG. 2) of the point 41 where the top of component 40 meets the top of component 36 intersects the edge 43 where side 18 meets end 22 and thus defines the upper limit of travel of bracket 34.

Near the top of the end component 40 of bracket 34 is a cutting edge 44 essentially as illustrated in FIG. 2. If a stick of gum 32 is only partially pushed out of the chewing gum dispenser 10 when bracket 34 is pushed in an upwardly direction, cutting edge 44 engages the stick of gum 32 and as the bracket 34 is pushed upwardly this cutting edge 44 severs the gum into two parts. As the bracket 34 is pushed toward its limit of travel, the inside surface 46 of cutting edge 44 slides over slot 30 and seals this slot 30 and in so doing protects the exposed end of the stick of chewing gum 32 from contamination.

Figure 3:
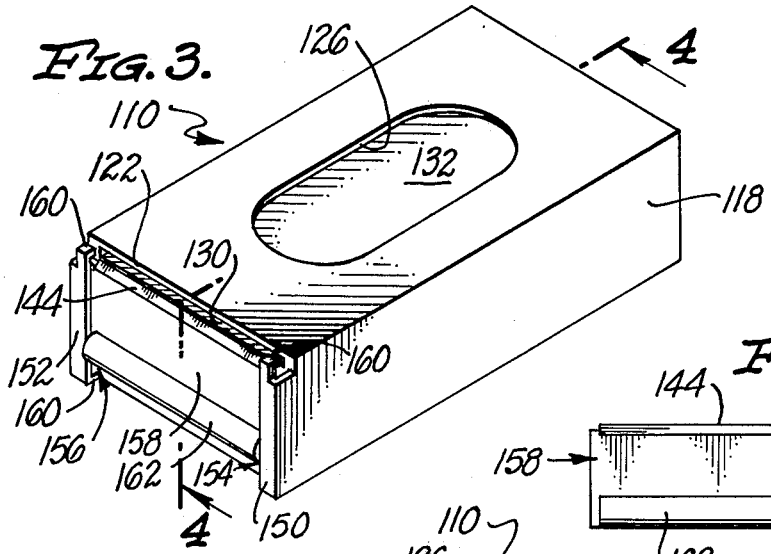
FIG. 3 is an isometric view of an alternate embodiment of the chewing gum dispenser.
Figure 5:
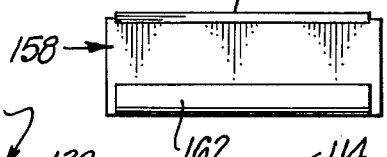
FIG. 5 is an elevational view of a blade utilized in the chewing gum dispenser shown in FIG. 3.
Figure 4:
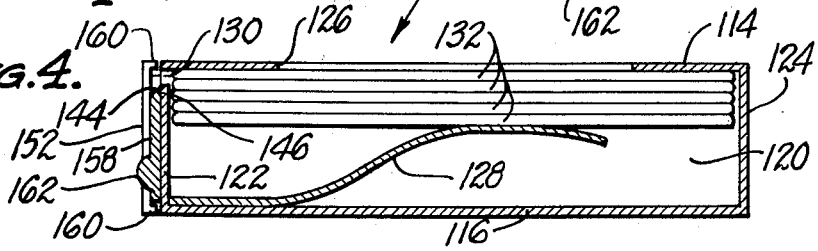
FIG. 4 is a sectional view of the chewing gum dispenser illustrated in FIG. 3 taken at the lines 4—4.

In FIGS. 3, 4 and 5 of the drawing there is shown a modified embodiment of a chewing gum dispenser 110 which is extremely similar to the chewing gum dispenser 10. For this reason various parts of these two chewing gum dispensers 10 and 110 which are identical or closely related are not separately described herein and are referred to in the drawings and where necessary for explanatory purposes in the remainder of this specification by the numerals previously used to designate these parts preceded by the numeral "1".

Sides 118 and 120 extend beyond front end 122. At the end of this extension a flange 150 and 152 projects at a 90 degree angle from sides 118 and 120, respectively. Flanges 150 and 152 together with front end 122 form channels 154 and 156 between the flanges and the front end. A cutting blade 158 is slidably mounted within channels 154 and 156. At both the top and bottom of these channels a small segment of these flanges collectively identified by numeral 160 is bent over and serves to keep the cutting blade 158 within channels 154 and 156. This allows cutting blade 158 to slide along front end 122. On the surface of cutting blade 158 is a raised projection 162 which serves as a point wherein a user's finger can forceably engage the cutting blade 158. Along the top edge 164 of cutting blade 158 is a cutting edge 144.

When used the user slides a stick of gum 132 partly through slot 130 by frictionally engaging the top of said stick of gum 132 through the elongated hole 126 with the user's finger. The user then slides cutting blade 158 in an upward direction and cutting edge 144 severs the stick of gum 132. The blade 158 is further slid to the limits of its travel until the cutting blade 158 meets with and abuts against the two top segments 160. At this point the inside surface 146 of the cutting edge 144 seals the slot 130 and protects the exposed end of the segment of gum remaining within the chewing gum dispenser 110.

For convenience, the rear ends 24 and 124, bottoms 16 and 116 or tops 14 or 114 could be hinged, allowing the chewing gum dispensers 10 and 110 to be loaded with their full complement of sticks of gum 32 and 132 in one operation; however, for simplicity, the loading method as described above is considered utilitarian.

I claim:

1. A chewing gum dispenser which comprises:

a rectangular box, said box having a top, a bottom, two sides, a front end and a rear end;

said box dimensioned to contain a plurality of sticks of chewing gum stacked one upon another;

said top having an elongated hole extending along the lengthwise dimension of said top;

biasing means within the interior of said box urging said sticks of chewing gum against the interior side of said top such that a portion of the topmost stick of chewing gum is exposed through said elongated hole;

said front end of said box having a slot extending from one side to the other side adjacent to said top;

said slot being dimensioned such that a stick of gum can pass through said slot;

said front end including a movable combination cutting and sealing means;

said combination cutting and sealing means having a first position wherein said combination cutting and sealing means extends over said slot and seals said slot;

said combination cutting and sealing means having a second position wherein said slot is exposed;

said combination cutting and sealing means reversibly moving between said first position and said second position such that when said combination cutting and sealing means is in said second position and the uppermost stick of gum within the interior of said box is slid along the interior surface of said top by frictionally engaging said uppermost stick of gum by the user inserting a finger through the elongated slot and pushing said stick of gum through said elongated slot exposing a portion of said stick of gum, and said combination cutting and sealing means is moved from said second position to said first position, causing said stick of gum to be severed by said combination cutting and sealing means, one portion of said stick of gum remaining inside said box and the second portion of gum being dispensed to the user.

2. The chewing gum dispenser of claim 1 wherein:

said biasing means comprises a flat curved spring attached at one end to said bottom of said rectangular box and extending from said bottom toward said top of said box, said flat spring being compressed toward said bottom of said box by sticks of chewing gum inserted in said elongated slot and stacked one upon the other between said top and said flat spring.

3. The chewing gum dispenser of claim 1 wherein:

said combination cutting and sealing means comprises a three sided bracket fitting around said front end of said box and said sides of said box, said three sided bracket rotatably mounted on said sides of said box, one side of said three sided bracket interspaced between the two other sides of said three sided bracket, said one side which is interspaced between the other two sides fitting flush against said front end of said box, said one side having a cutting edge proximal to the top of said one side, said cutting edge passing over said elongated hole in said front end of said box as said bracket is rotated, said cutting edge severing said stick of gum projecting through said elongated hole and said cutting edge sealing said elongated hole at the limit of travel of said three sided bracket around said rotatable mounting.

4. The chewing gum dispenser of claim 1 wherein:

said combination cutting and sealing means comprises the ends of said sides of said box extending beyond said front end of said box, flange means attached to said ends of said sides extending beyond said front end such that a channel is formed between said flange means and said front end;

a cutting blade slidably mounted in said channel, said cutting blade having a cutting edge proximal to the uppermost portion of said cutting blade, said cutting blade sliding in said channels and said cutting edge severing said stick of gum projecting through said elongated hole and said cutting surface of said cutting blade sealing said elongated hole at the limit of travel of said cutting blade.

* * * * *